United States Patent [19]

Kinart

[11] 4,042,240

[45] Aug. 16, 1977

[54] ARCHERY TARGET

[76] Inventor: Gregory John Kinart, 7020 Packer Drive, Wausau, Wis. 54401

[21] Appl. No.: 641,546

[22] Filed: Dec. 17, 1975

[51] Int. Cl.[2] ..... F41J 3/00

[52] U.S. Cl. ..... 273/102 B; 273/102.4

[58] Field of Search ..... 273/95 R, 102 R, 102 S, 273/102.4, 102 B, 105.6

[56] References Cited

U.S. PATENT DOCUMENTS

| | | | |
|---|---|---|---|
| 1,166,496 | 1/1916 | Torrey | 273/102.4 |
| 1,602,441 | 10/1926 | Mallery | 273/102 B |
| 1,818,939 | 8/1931 | Brading | 273/102 B |
| 2,193,727 | 3/1940 | Jouffray | 273/102 B |
| 2,770,460 | 11/1956 | Deasy | 273/102 B |
| 3,227,449 | 1/1966 | Schwab | 273/102.4 |
| 3,367,660 | 2/1968 | Di Maggio | 273/102 B |
| 3,476,390 | 11/1969 | Roloff | 273/102 B |
| 3,902,721 | 9/1975 | Piccini | 273/102 B |

*Primary Examiner*—William H. Grieb
*Attorney, Agent, or Firm*—Arthur J. Hansmann

[57] ABSTRACT

An archery target having a frame for supporting two screens of elastic material in parallel and spaced apart positions for penetration by an arrow. Support rods and a back stop material are attached to the frame as a part of the target for stopping the arrow after penetration of the two screens.

6 Claims, 6 Drawing Figures

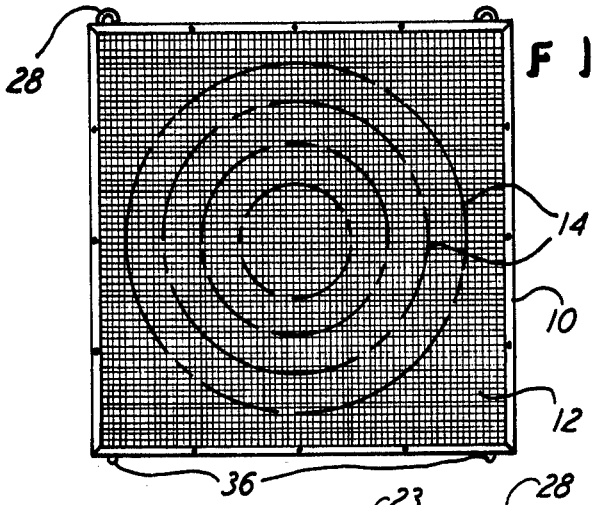
FIG. 1
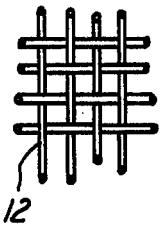
FIG. 5
FIG. 3
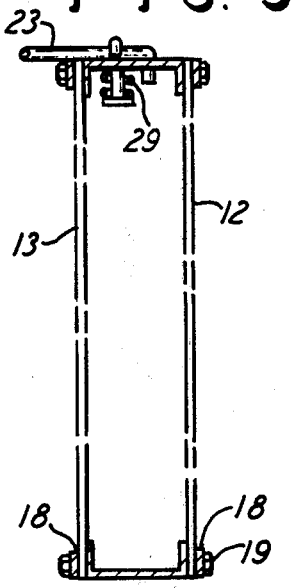
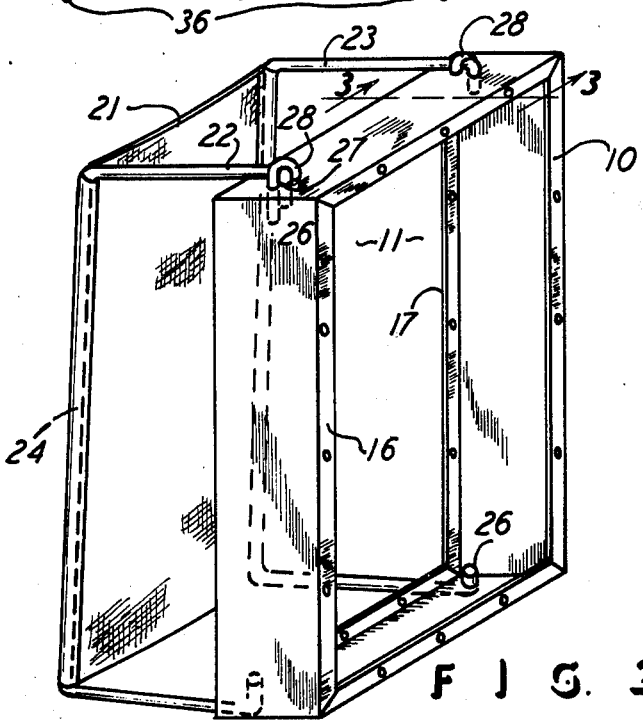
FIG. 2
FIG. 6
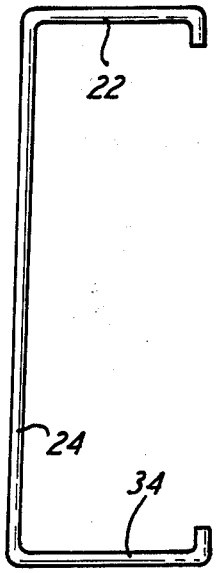
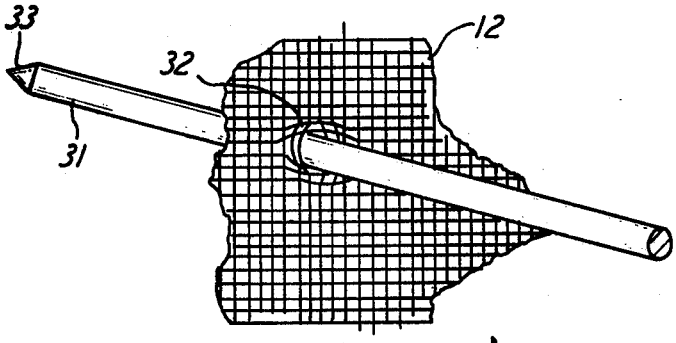
FIG. 4

ARCHERY TARGET

This invention relates to an archery target, and, more particularly, it relates to an archery target which is self-renewing after penetration by an arrow so that the target is not damaged or left with an opening created by the arrow.

BACKGROUND OF THE INVENTION

Archery targets are commonly known and are provided in the form of stuffed material, including the old and well known straw or hay type of stuffing enclosed by burlap material having an archery target or bull's eye thereon. More modern and useful forms of archery targets are known to include targets having filler or stuffing material which is not in the nature of hay, and these are therefore improvements upon the type of target shown is U.S. Pat. No. 1,818,939, for instance. That is, the more modern type of target is shown in U.S. Pat. No. 3,367,660 and 3,476,390 wherein the target is arranged with laminations of foam rubber and screens, and the arrow can of course penetrate that type of target which is somewhat recoverable after penetration. Still further, the prior art is aware of the arrangement of archery targets wherein there are spaced apart panels and a back stop piece, such that the arrow can penetrate the spaced apart panels and come to rest at the back stop piece, and an example of that type of target is seen in U.S. Pat. No. 1,602,441. However, the latter-mentioned type of target is not a recoverable target but, instead, it is in fact one which must be repaired or maintained in proportion to the use, since the panels which are penetrated by the arrow are of solid material, such as cardboard, and of course they actually leave a hole created by the penetration of the arrow.

Accordingly, the present invention provides an archery target which is an improvement upon the targets heretofore known. More specifically, the present invention provides an archery target which is completely recoverable to its original form, after penetration by an arrow, and therefore the maintenance and repair of the target is virtually nonexistant.

Still further, the present invention provides an archery target which is highly maneuverable and is lightweight and is readily and easily provided, and the target is arranged so that the arrow is securely and accurately held in the target, to reveal the location of the arrow relative to the target, but yet the arrow can be withdrawn from the target and the entire target recovers to its original configuration and is therefore endlessly reusable in that it is self-renewing. In accomplishing this objective, the target of this invention is arranged with two spaced apart screens of interwoven elastic strands of material which permit the arrow to penetrate the screens, and the two screens hold the arrow in the precise location of penetration, and a back stop material is provided for stopping the arrow.

Still further, the target of this invention is arranged so that it can be readily and easily positioned for use, such as on a table or a floor or the like, and the target presents a face inclined slightly upwardly and is retained in a stable position, and the target is also arranged so that it can be readily and easily collapsed or folded for purposes of transport and storage.

Other objects and advantages will become apparent upon reading the following description in light of the accompanying drawings.

BRIEF DESCRIPTION OF THE DRAWINGS

FIG. 1 is a front elevational view of the target of this invention.

FIG. 2 is an enlarged front perspective view of the target of FIG. 1 and with parts thereof removed.

FIG. 3 is a sectional view taken along the line 3—3 of FIG. 2.

FIG. 4 is a view of a fragment of one of the screens and showing the arrow piercing the screen.

FIG. 5 is a front elevational view of a fragment of the interwoven screens used in this target.

FIG. 6 is a side elevational view of the stand or support member utilized in this target.

DETAILED DESCRIPTION OF THE PREFERRED EMBODIMENT

The drawings show the target of this invention to include a rectangular-shaped frame 10 which may be made of channel-shaped members, such as metal channels secured together, such as by welding or the like, as their ends which form the corners of the rectilinear frame 10. The frame 10 has a central opening designated 11, and target screens 12 and 13 are suitably attached to the frame 10 to be spaced apart and to extend in parallel planes, such as indicated in FIG. 3. FIG. 1 shows the front screen 12 to be attached to the frame 10 and to span the opening 11, just as the rear frame 13 would do, and the front frame 12 may include indicia for a target with the concentric circles, as designated by the dot-dash lines 14. FIGS. 1, 2, and also show that the interwoven mesh screens 12 and 13 are suitably affixed to the frame 10 at the frame front face 16 and rear face 17, respectively, and the screens 12 and 13 may be secured to the frame 10 by means of clamp bars 18 which overlie the edges of the respective screens and are secured to the frame 10 by means of screws 19, by way of one example of securing the screens to a frame. Thus, in actual practice, the screens 12 and 13 are tautly stretched onto the frame 10 so that both screens 12 and 13 span the opening 11 and are on the respective front and rear faces 16 and 17 of the frame 10. Also, the screens are made of interwoven strands, and are preferably of a monofilament material, such as nylon, of a 20 mil diameter, interwoven into a mesh of a size of 10 by 10 strands per square inch, all in a preferred arrangement.

A fabric type of back stop material 21 is suitably disposed across the rear of the target 10 and is supported on the supporting member 10 which includes two rods 22 and 23 attached to the member 10 and extend rearwardly thereof and which are C-shaped to have the intermediate lengths 24 support the back stop material 21. Therefore, the back stop material 21 may have a hem sewn to each opposite side of material 21, and the support rods 22 and 23 can be threaded through the loop in the hem for disposing and retaining the back stop 21 in the position shown in FIG. 2. Accordingly, the back stop 21 is disposed at least substantially parallel to the planes of the screens 12 and 13, and the back stop material is preferrably nonpenetrable by the archery arrow, and it may be of a material identical to that commonly used in rotary lawn mower catcher bags well known in the mower industry and which are of a strength sufficient to preclude penetration by stones and nails and the like during the course of mowing. The rods 22 and 23 have inturned ends 26 which project through openings 27 in the frame 10, and thus the support rods 22 and 23 are attached to the frame 10 in the positions shown. Also, a releasable clamp, such as the J-shaped clamps 28 are attached to the frame 10 and extend over the respective rods 22 and 23 to hold the rods in their rearward extent from the frame 10, as shown in FIGS. 2 and 3. A compression spring 29 is shown interposed between the frame 10 and the lower end of the clamp 28, and thus it will be understood that the clamp 28 can be raised off the rod 23 and can be moved to where the rod 23 can fold inwardly toward the frame rear face 17, and thus the entire target can be placed in a stored and collapsed condition, and the same is true of the rod 22 and its clamp 28.

FIGS. 4 and 5 show that the screens 12 and 13 are arranged in an interwoven fashion and have the characteristics described above, and FIG. 4 shows an archery arrow 31 penetrating the front screen 12, and the screen strands 32 surrounding the arrow 31 are disposed by the arrow 31 but they are not broken or damaged in any way. Upon retraction of the arrow 31 from the screen 12, the screen strands at the location designated 32 will return to their normal interwoven pattern as shown elsewhere in FIG. 4 and as shown in FIG. 5, and thus the screens 12 and 13 fully recover to their normal shape, due to the elastic nature of the screen strands, as described. Also, by virtue of the two screens 12 and 13 being of the same construction and in spaced apart parallel planes, the arrow 31 would penetrate both screens and would be held in the original position of penetration and thus one would know the precise and accurate striking of the arrow with respect to the target. Of course the arrow would continue penetration of the screens 12 and 13 and would have its tip 33 encounter the back stop 21 and the arrow would then be stopped and intercepted since it would not penetrate the back stop 21 because of the nature and strength of the material in the back stop 21.

In addition to providing a folable type target having the stand or support arrangement of the rods 22 and 23, the rods 22 and 23 are arranged so that the target frame 10 is inclined slightly rearwardly at the top so that if it were placed on the floor it would be facing slightly upwardly in a desirable position for the user, and that is arranged by virtue of the slightly less than 90° angle between the rod intermediate lengths 24 and lower end lengths 34, as seen in FIGS. 2 and 6, and of course securing members of weights can be placed on the lengths 34 so that the target frame 10 will remain in the slightly tipped or upwardly facing position described. Thus, the rods 22 and 23 can extend underneath the frame and serve as feet, as designated 36 in FIG. 1, and the rods also extend rearwardly of the frame 10 to render the target stable in response to the force of the arrow penetrating the target. Accordingly, the target is reusable and susceptable to retaining its original condition after many penetrations by arrows, and the screens 12 and 13 fully recover to their original position, due to the elasticity of the stands interwoven to form the screens which are simply shown in the dot-dash lines in FIG. 3.

What is claimed is:

1. An archery target comprising a supporting member having an opening therein, two arrow-penetrating screens supported on said supporting member in spaced apart parallel planes and spanning said opening and consisting of woven strands of elastic material and having a mesh which permits penetration by an archery arrow and with said screens being adapted and arranged to hold the arrow at the position and angle of penetration of said screens, said strands being woven in a taut cross-strand pattern and with the strands being free of physical attachment to each other and thereby being free to slide on each other and move apart when contacted by the arrow and to elastically return to said pattern when the arrow is removed from said screens, and an archery arrow back stop material supported from said supporting member in a plane parallel to and aligned with said screens and being adapted to intercept the arrow penetrating said screens.

2. The archery target as claimed in claim 1, wherein said supporting member includes a back stop material support attached to said supporting member and extending therefrom offset from said planes of said screens to present a stand for said supporting member.

3. The archery target as claimed in claim 1, wherein said supporting member has spaced apart front and rear faces, relative to a direction of the approach of the arrow, and with said screens being respectively extending across said faces in the said spaced apart parallel planes.

4. The archery target as claimed in claim 1, wherein said screens are made of a monofilament nylon of 20 mil diameter and are woven in a mesh of size of 10 by 10 strands per square inch.

5. An archery target comprising a supporting member having an opening therein, two screens supported on said supporting member in spaced apart parallel planes and spanning said opening and consisting of woven strands of elastic material and having a mesh which permits penetration by an archery arrow and with said screens being adapted and arranged to hold the arrow at the position and angle of penetration of said screens, and an archery arrow back stop material supported from said supporting member in a plane parallel to and aligned with said screens and being adapted to intercept the arrow penetrating said screens, said supporting member including a back stop material support attached to said supporting member and extending therefrom offset from said planes of said screens to present a stand for said supporting member, said support being two C-shaped rods having the free ends of each of said rods attached to said supporting member, and with the intermediate length of each of said rods being disposed offset from said supporting member and spaced apart and with said back stop material supported on intermediate lengths and extending across the space therebetween.

6. The archery target as claimed in claim 5, wherein said rods are pivotally attached to said supporting member for folding relative to said supporting member and thereby rendering the target compact in a folded and inoperative condition.

* * * * *